United States Patent [19]

Fraser et al.

[11] 4,204,922

[45] May 27, 1980

[54] SIMULTANEOUS ELECTRODISSOLUTION AND ELECTROWINNING OF METALS FROM SIMPLE SULPHIDES

[75] Inventors: Donald B. Fraser, Rankin Park; Alexander Dim, Speers Point; Kevin E. Anthony, Cardiff; Wayne R. Costello, Dudley; Phillip E. Grazier, Kilaben Bay, all of Australia

[73] Assignee: The Broken Hill Propietary Company Limited, Melbourne, Australia

[21] Appl. No.: 964,351

[22] Filed: Nov. 28, 1978

[30] Foreign Application Priority Data

Dec. 6, 1977 [AU] Australia ..... PD2671

[51] Int. Cl.[2] ..... C25C 1/00; C25C 1/06; C25C 1/12; C25C 1/16

[52] U.S. Cl. ..... 204/105 R; 204/107; 204/108; 204/109; 204/111; 204/112; 204/113; 204/114; 204/117; 204/118; 204/119; 204/120; 204/123; 204/128

[58] Field of Search ..... 204/105 R, 107, 108, 204/109, 111-114, 117-120, 128, 123

[56] References Cited

U.S. PATENT DOCUMENTS

| | | | |
|---|---|---|---|
| 2,839,461 | 6/1958 | Renzoni et al. | 204/113 |
| 3,673,061 | 6/1972 | Kruesi | 204/107 |
| 3,736,238 | 5/1973 | Kruesi et al. | 204/107 |
| 3,787,293 | 1/1974 | Kametani | 204/107 |

*Primary Examiner*—R. L. Andrews

*Attorney, Agent, or Firm*—Murray and Whisenhunt

[57] ABSTRACT

A process for simultaneous electrodissolution and electrowinning of metals from simple sulphide minerals comprises establishing a cell having (i) an anode compartment or compartments containing a suspension of particulate sulphide mineral, the metal content of which is being selectively liberated by an oxidizing environment attributable to the anode;

(ii) a cathode compartment or compartments in which the liberated metal values are electrolytically recovered;

(iii) one or more ion permeable membranes, impermeable to the particulate solids in the suspension, separating the anode and cathode compartments;

(iv) an electrolyte containing anions of soluble salt(s) of the said liberated metal or metals in both anode and cathode compartments;

introducing direct electric current into the cell, and recovering metal values from the cathode.

13 Claims, 4 Drawing Figures

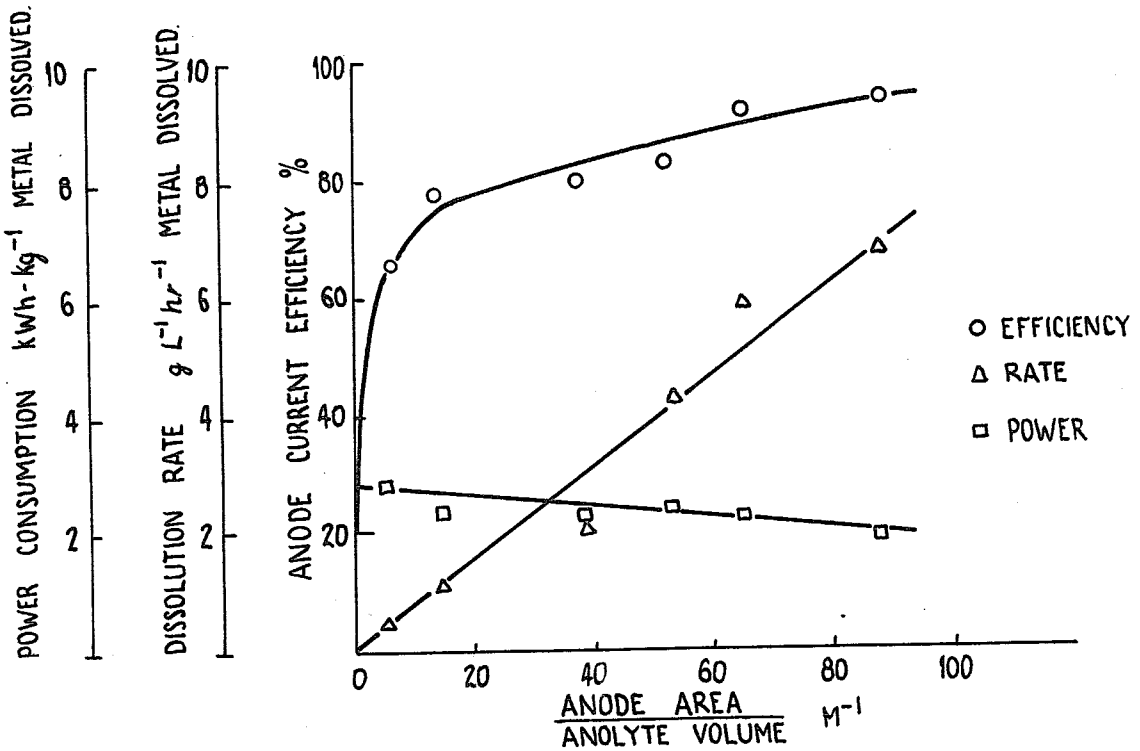
FIG. 3. EFFECT OF $\frac{\text{ANODE AREA}}{\text{ANOLYTE VOLUME}}$ ON EFFICIENCY, DISSOLUTION RATE & POWER CONSUMPTION

SIMULTANEOUS ELECTRODISSOLUTION AND ELECTROWINNING OF METALS FROM SIMPLE SULPHIDES

This invention relates to the recovery of metals from their sulphide minerals by electrolysis.

The disadvantages of conventional pyrometallurgical processes for the recovery of metals from their sulphide ores are well known, and include the acute environmental problems associated with the disposal of by-product sulphur dioxide which is a noxious and corrosive pollutant. Accordingly attempts have been made to develop non-polluting electrolytic processes in which combined sulphur is converted to elemental sulphur and the liberated metals are recovered from solution. However, the attainment of efficient electrochemical dissolution has eluded the prior art for various reasons and consequently no economic electrolytic process for recovery of metals from their sulphide minerals has hitherto been accomplished.

Thus for example U.S. Pat. No. 3,673,061 to Kreusi and U.S. Pat. No. 3,736,238 to Kreusi et al purport to effect dissolution of the sulphide minerals by direct electrochemical means without the aid of intermediate oxidising lixiviants. These patents claim applicability to the processing of sulphide minerals of the metals in Groups IB, IIB, IVA, VA and VIA of the Periodic Table and of lead. The two patents differ mainly in the specification of electrolyte composition. In the latter patent the electrolyte comprised an acid aqueous solution of at least one chloride salt selected from the chlorides of Al, Cr, Cu, Fe, Mn, Ni, Zn and rare earth metals, and mixtures thereof, the solution having a concentration of between 0.5 N and saturation. The pH was required to be "maintained" below 3.9. It also stated the preferred use of any such electrolyte in combination with an alkali metal chloride and/or alkali earch chloride, that any of the chloride electrolytes could be used for dissolution of any of the metals specified, and that the "temperature and pH range were the most critical parameters". Both patents claim as one of the critical process parameters the anode current density which is specified to be greater than 12 amps/ft$^2$ (130 amps/m$^2$).

The authors of the abovementioned U.S. patents clearly attach no special importance to cell or anode design. In U.S. Pat. No. 3,673,061 the author describes the cells utilised as being "known in the art". In U.S. Pat. No. 3,736,238 it is stated that the process is "not limited to a specific electrolytic cell design or type of cell", however both diaphragm and non-diaphragm cells were used. No description of the cell or the anode configuration was given.

The prior art has regarded cell and particularly anode configuration as unimportant and has taught that process parameters such as solution conditions and current density are critical. However from the data presented in the various examples used to illustrate the processes described in the above patents, it is readily seen that electrical efficiencies are low and that metal recoveries are below optimum.

Furthermore both patents state that "the term metal sulfide as used herein is inclusive of the complex as well as the simple sulfide minerals" and no distinction is drawn therebetween.

The present invention is concerned with treatment of simple sulphide minerals, and is not applicable to mixed metal sulphides.

We have found that efficient electrochemical treatment of simple sulphide minerals, without the aid of oxidising lixiviants, may be accomplished by adoption of certain anode compartment design criteria which achieve high dissolution rates, high current efficiencies, a wide operating range of anode current densities and low specific power consumption.

Although we do not wish to be limited by any postulated chemical or physical theories underlying the practical success of our present invention, we offer the following discussion as a possible explanation of the processes involved.

When a mixed metal sulphide such as, for example, chalcopyrite ($CuFeS_2$) is treated electrolytically, only copper is electrodeposited at the cathode leading to an imbalance between the anodic and cathodic processes and hence to electrical and chemical inefficiencies and parasitic side reactions of hydrogen evolution as indicated by the following equations:

Anode: $CuFeS_2 \rightarrow Cu^+ + Fe^{3+} + 2S^\circ + 4e$

Cathode: $Cu^+ + e \rightarrow Cu^\circ$ $3H_2O + 3e \rightarrow \frac{3}{2} H_2 + 3OH^-$ In terms of metal recovering the process is only 25% electrically efficient. Furthermore, addition of acid is required to maintain operating pH conditions.

Quite different considerations apply to the electrolysis of simple sulphide minerals.

By simple sulphide minerals we mean metal sulphides of chemical structure which may be represented by $M_nS$ (where n is appropriate to the valency of the metal, e.g. n=0.5, 1 or 2), or to mixtures of such metal sulphide minerals, and the total cationic species M is to be recovered. For example the metal, M, may be Cu, Zn, Pb, Ni, Sb, Sn, Mo or Ag.

The electrochemical reactions within the process cell in this case may be characterised by the following equations:

Anode: $MS \rightarrow M^{2+} + S^\circ + 2e$ or $M_2S \rightarrow 2M^+ + S^\circ + 2e$ Cathode: $M^{2+} + 2e \rightarrow M$ or $2M^+ + 2e \rightarrow 2M$ The anode process is the oxidation of sulphide ions to elemental sulphur, in the course of which metal ions are liberated. Elemental sulphur forms a residue in the anolyte and the process is in electrical and chemical balance.

Because the reactions are electrically and chemically balanced, no additions of materials, other than the mineral to be processed, are required and the process specific power consumption is inherently low. Specifically, $H^+$ does not appear in the equations and the process is self adjusting without the need for pH control.

As indicated above, we have also found that certain cell design features are of importance.

One embodiment of the invention accordingly provides a process for simultaneous electrodissolution and electrowinning of metals from simple sulphide minerals which comprises establishing a cell having (i) An anode compartment or compartments containing a suspension of particulate sulphide mineral, the metal content of which is being selectively liberated by an oxidising environment attributable to the anode;

(ii) A cathode compartment or compartments in which the liberated metal values are electrolytically recovered;

(iii) One or more ion permeable membranes, impermeable to the particulate solids in the suspension, separating the anode and cathode compartments;

(iv) An electrolyte containing anions of soluble salt(s) of the said liberated metal or metals in both anode and cathode compartments. In this context we use the term "soluble" in the sense of sufficiently soluble to enable the electrolytic recovery of the metal values at the cathode.

Among suitable anions there may be mentioned by way of example chloride, sulphate, nitrate and fluosilicate.

A significant parameter in this aspect of the invention is maximisation of the frequency of collisions between individual mineral particles and the feeder electrode, which for dissolution of sulphide minerals, is the anode.

The following cell design criteria contribute to this purpose:

(i) The feeder electrode area available to each particle is a maximum.

(ii) The feeder electrode area is deployed in a manner so as to maximise collision frequency.

(iii) The agitation of the slurry is such as to provide optimal particle trajectories relative to the deployment of the feeder electrode area and to minimise time between successive particle-electrode collisions.

A convenient measure of the first criterion is the ratio of feeder electrode area to the volume of anolyte which should be greater than 10 and preferably greater than 50. Although the second and third criteria cannot be quantified a priori, they can be optimised by comparison of cell operating parameters with results of theoretically based techniques. For example, as a measure of compliance with these criteria for a particular cell configuration and agitation, the resulting electrode potential of the cell can be compared with that obtained on dissolving the mineral under study in a system which has known hydrodynamics, such as for example a rotating disc electrode cell, where electrode efficiency is 100% and a true dynamic dissolution potential is measured for that mineral.

The anode compartment or compartments contain a feeder electrode or a multiplicity of such electrodes of suitable design and deployment to meet the criteria defined above, immersed in an anolyte comprising sulphide particles preferably not exceeding 200 μm and more preferably not exceeding 60 μm in size suspended by means of agitation in an electrolyte. The electrodes may be constructed of any suitable material such as, for example, graphite. The anolyte or anolytes is separated from a contiguous catholyte or catholytes by an ion permeable membrane (diaphragm).

The cathode compartment or compartments contain a cathode or a multiplicity of cathodes at which the metal values are to be recovered, immersed in a clear solution of the electrolyte. The electrodes may be constructed of any suitable material such as, for example, lead or stainless steel which are less susceptible to mechanical damage than graphite during mechanical handling, and may have any configuration to attain a suitable current density and be suitable for subsequent recovery of the electrodeposited metal or metals. Whilst agitation of the catholyte is not necessary, it has been found preferable where higher current densities are used, for example, above about 150 amps/m$^2$.

Alternatively, the cathode compartment or compartments may contain a feeder electrode or a multiplicity of feeder electrodes immersed in a slurry of suitable conductive particles such as, for example, graphite or the most noble metal to the electrowon, maintained in suspension by either a fluidising flow of electrolyte or by agitation. In this case the metal values are recovered predominantly on the particles contained in the catholyte. Suitable techniques, well known in the art, may be implemented to recover the solids from the catholyte.

The diaphragm serves to delineate continuous anode and cathode compartments. It should be of a material inert to chemical attack by the electrolyte and such as to allow free passage of the dissolved ion species while preventing the passage of solid materials present in the separate compartments of the cell.

The electrolyte preferably contains the following dissolved components:

(i) Alkali metal salts and/or alkaline earth salts, such as, for example, NaCl, KCl or $CaCl_2$, in concentrations high enough to provide adequate electrical conductivity. The upper limit of this component concentration will be determined by the total anion concentration as stated below.

(ii) The salt of the metal present in the sulphide mineral to be processed or, in the case of mixtures of sulphide minerals, the salt of the least noble metal present in the mineral to be treated for example, $ZnCl_2$ for a mineral containing, for example, PbS and ZnS. The presence of this component prevents hydrogen evolution at the cathode, with the concomitant pH increase in the catholyte, during the initial electrolysis period while the necessary diffusion gradients are being set up in the cell. The concentration of this component in the initial electrolyte will be governed by the current utilised and by the absolute and relative volumes of the anolyte and catholyte compartments. The upper limit to the total anion concentration is set by the mutual solubility of the metal ions present in the solution.

The choice of the preferred electrolyte depends on the major metal present in any mixture of sulphides, in accordance with current art of hydrometallurgical recovery of that metal. For example: Zinc—Sulphate media; Copper—Sulphate or chloride electrolytes; Nickel—Sulphate media; Lead—Fluosilicic acid electrolyte.

Due to the balanced electrochemical reactions described in this invention and attributable to high anode efficiencies and the presence of appropriate metal salts in the electrolyte, as described above, the pH of the electrolyte attains a steady value in the range 0 to 5 and does not require control through acid additions as has been found necessary in the prior art. Thus when operating with concentrates of sulphide minerals, for example, a mixture of PbS and ZnS, with particle size not exceeding 100 μm and in an electrolyte as described above, in a cell according to the present invention, no acid makeup was required to maintain the electrolyte pH.

We have unexpectedly found that the cell, if operated with close control of current densities and power input, is stable with respect to anion concentration and self adjusting with respect to pH and that anode current densities as low as about 2 amp/m$^2$ are effective. Higher current densities may be used to increase the total cell current and thus increase cell production rate. Electrolyte temperatures within the range 60° C. to 90° C. are desirable.

In the accompanying drawings:

FIG. 3 illustrates the results of experiments described in Working Example 3 below;

EXAMPLE OF CELL DESIGN

The following description of an electrochemical cell which meets the criteria described above is presented by way of an example and is not to be taken as limiting the invention.

Figure 1:
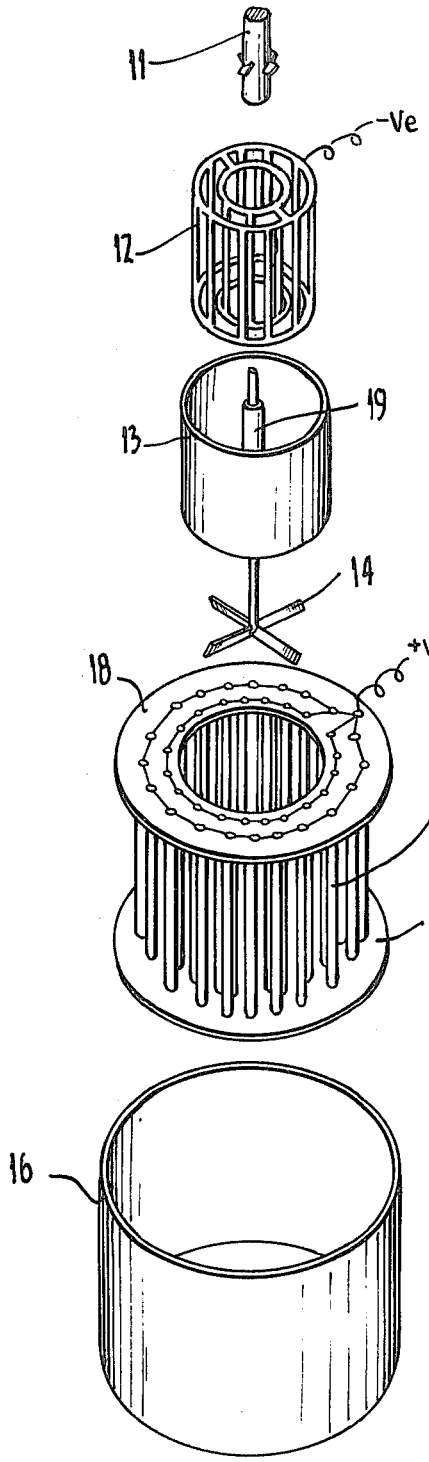
FIG. 1 is an exploded view of an electrochemical cell as more particularly described in the Examples 1 and 2 below.

The cell, shown schematically in FIG. 1, comprises a circular vessel 16 separated by an ion permeable diaphragm 13 into an annular outer compartment containing the anolyte and an inner cylindrical catholyte compartment. The latter compartment does not extend to the full depth of the vessel.

The anolyte compartment contains a series of graphite rod feeder electrodes (anodes) 15 deployed in a circular fashion about the catholyte compartment and connected at their lower end to a graphite plate 17 which extends over the entire cell cross-section. The upper ends of the anode rods are connected to each other and to the current feeder bus 18 so as to maintain the entire anode assembly as nearly as possible at a uniform potential.

The catholyte compartment contains a similar array of lead rod electrodes (cathodes) 12 on which the dissolved metal species are recovered. However, instead of being connected by a plate at the lower end, they are interconnected by a series of short lead rods to provide an open structure while giving the array the required mechanical rigidity.

A centrally located stirrer shaft passes through the bottom of the catholyte compartment into the anolyte compartment where the impeller blades 14 are located. The blades are pitches so as to provide a downdraft current of the anolyte slurry onto the bottom anode plate. Thus the mineral particles are forced to impinge on the anode surface and, after rebounding, swirl past the rods, periodically impinging on them also, thereby ensuing the maximum number of particle-electrode collisions as is required by the cell criteria. The stirrer shaft is insulated from the catholyte by means of a collar 19 fixed into the bottom of the catholyte compartment and extending above the level of the liquid in the compartment.

If it is necessary to stir the catholyte compartment as well, another shaft 11, made of suitable tubing to fit over the collar of the main shaft and connected to the main shaft above the liquid level may be provided. Care should be taken that the two shafts are electrically insulated from each other at their point of connection.

Those skilled in the art can readily see that the two compartments can be interchanged with suitable modification of electrode arrays and that plate cathodes may be easily substituted for the rod cathodes described in the present example.

Figure 2:
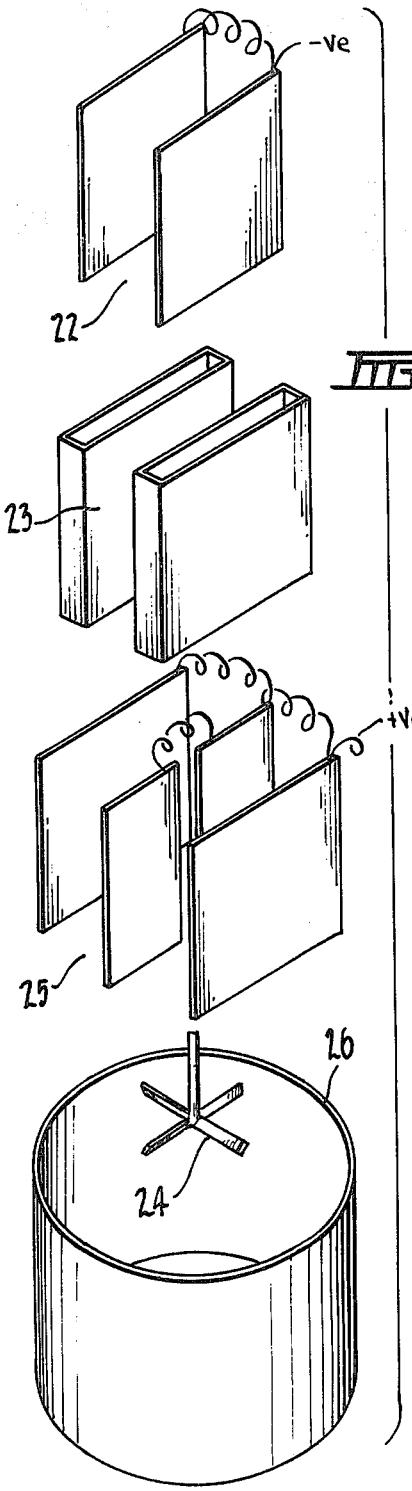
FIG. 2 illustrates an alternative construction as described in Working Example 3 below.

The cell illustrated in FIG. 2 comprises a vessel 26 in which plate cathodes 22 and plate anodes 25 are employed, the anolyte and catholyte being separated by ion-permeable diaphragms 23. The anolyte is stirred by impeller blades 24. This cell has a low ratio anode area/anolyte volume.

Figure 4:
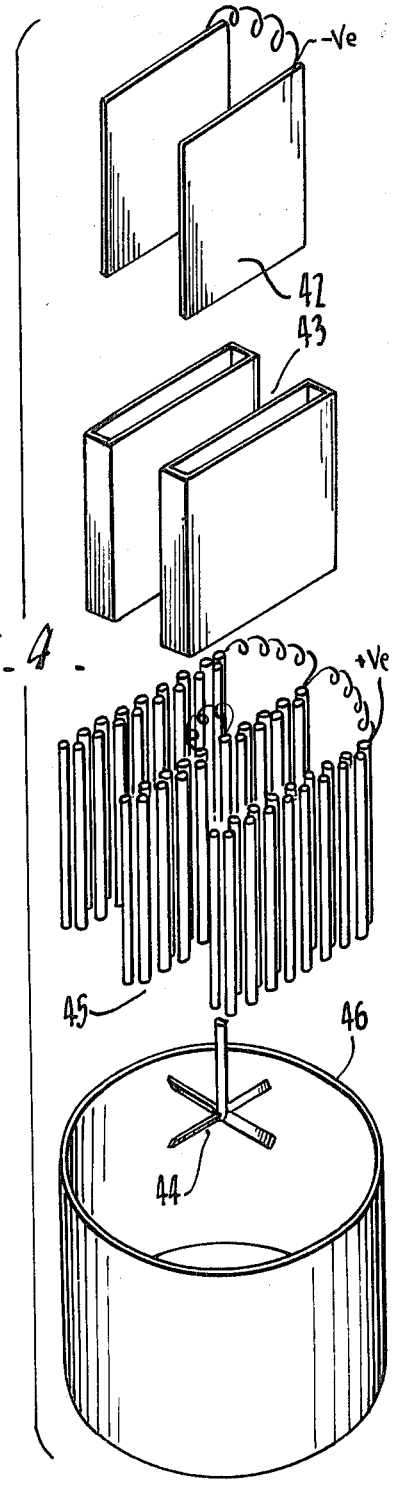
FIG. 4 illustrates an alternative construction as described in Working Examples 4 and 5 below.

The cell illustrated in FIG. 4 comprises a vessel 46 having plate cathodes 42 and rod anode arrays 45 in their respective compartments separated by ion-permeable diaphragms 43, the anolyte being stirred by impeller blades 44.

WORKING EXAMPLE 1

A commercial lead concentrate containing 42.9% lead, 6.5% zinc and 3.95% iron was treated in a cell as illustrated in FIG. 1., which had an anode area/anolyte volume ratio of 55 $m^{-1}$. A feed of 265 g was slurried in 2.65 L of electrolyte. The conditions and results were as follows:

Electrolyte: 3 M NaCl, 0.08 M $PbCl_2$
Acidity: pH 3.0
Anode Current Density: 100 $A/m^2$
Current Passed: 60 A hr (2.25 F)
Metal Liberated: 0.932 g ions
elemental Sulphur formed: 0.867 g atoms
Sulphate formed: 0.065 g ions
Dissolution Efficiency: 85%

WORKING EXAMPLE 2

A cell of the type illustrated in FIG. 1 and having an anode area/anolyte volume ratio of 90 $m^{-1}$ was used to electrochemically dissolve a sulphide mineral concentrate having the following composition:

Zn—26%, Pb—7.7%, Fe—12.6% (present as $FeS_2$)

Particle size was below 38 μm with 85% being below 21 μm. The electrolyte was a 3 M solution of NaCl with an additional 0.75 M $ZnCl_2$. The dissolved zinc and lead were simultaneously electrodeposited on the cathode.

A series of experiments was conducted to investigate the effect of current density on the process. The conditions and results are given in the following table:

| | | | |
|---|---|---|---|
| Current passed Amp-h | 0.45 | 1.88 | 14.4 |
| Anode Current Density Amp $m^{-2}$ | 2.1 | 8.7 | 66.5 |
| Metal liberated g-ions | 0.0081 | 0.035 | 0.235 |
| Theoretical liberation g-ions | 0.0084 | 0.035 | 0.269 |
| Dissolution rate g $h^{-1}L^{-1}$ | 0.89 | 2.67 | 4.87 |
| Dissolution efficiency | 96 | 100 | 87 |

Contrary to the teaching of the prior art, high dissolution efficiencies were obtained at anode current densities as low as 2.1 Amp $m^{-2}$.

WORKING EXAMPLE 3

A series of experiments was performed to determine the effect of the anode area/anolyte volume ratio on process performance. The sulphide mineral utilised had the following composition:

Zn—51.1%, Pb—4.3%, Fe—7.3%.

Particle size was 88% passing 74 m with 52% passing 38 m. In all runs the initial solids loading was 100 g $L^{-1}$. The electrolyte used was 3 M NaCl with an additional 0.75 M $ZnCl_2$.

The anode area/anolyte volume ratio (A/V) was varied in the range 6.6 $m^{-1}$ to 88 $m^{-1}$. For the smaller area/volume runs a parallel plate electrode configuration was used, having 1 cathode—2 anodes for an area/volume ratio of 6.6 $m^{-1}$ and 2 cathodes—3 anodes for a ratio of 14.6 $m^{-1}$ (shown schematically in FIG. 2). For all other runs a cell similar to that shown in FIG. 1 and described above was used. Anode area was varied by changing the number of rods in the anode assembly.

Anode current density was 80 Amps $m^{-2}$ in all but two cases ($A/V=37.2\ m^{-1}$ and $88\ m^{-1}$) where it was 60 Amps $m^{-2}$.

The effect of anode area/anolyte volume ratio on the dissolution rate, the specific power consumption and the anode current efficiency is shown in FIG. 3.

The data presented show that anode current efficiency and dissolution rate increase and specific power consumption decreases with increase in the feeder electrode area available for particle collision.

WORKING EXAMPLE 4

An experiment was performed using a commercial zinc concentration containing 28.6% sulphur, 51.2% zinc, 3.23% lead and 7.3% iron. A feed of 590 g was suspended in 5.9 L of electrolyte. The anode consisted of arrays of staggered rods as shown in FIG. 4, and resulted in an anode area/anolyte volume (A/V) ratio of 33 $m^{-1}$. This represents a practical cell design with sufficiently high A/V ratio and allows adequate diaphragm surface area, and resultant balanced electrode efficiencies. The conditions and results were as follows:

Electrolyte: 1.0 M $ZnCl_2$, 1.25 M NaCl
pH: 3.0
Temperature: 80° C.
Anode Current Density: 85 $A/m^2$
Current Passed: 235 Ahr (8.7 F)
Metal Liberated: 3.75 g ions
Elemental Sulphur formed: 4.2 g atoms
Dissolution Efficiency: 95%

This example illustrates the rejection of sulphur in elemental form.

WORKING EXAMPLE 5

A commercial zinc concentrate containing 51.2% zinc, 3.23% lead and 7.3% iron was treated in sulphate and chloride media in the same cell with an A/V ratio of 33 $m^{-1}$. A feed of 590 g was slurried with 5.9 L of electrolyte. The conditions and results are given in the following table:

| Electrolyte | 1.0M $ZnCl_2$, 1.25M NaCl | 1.0M $ZnSO_4$, 1.0M $NA_2SO_4$ |
|---|---|---|
| pH | 3.0 | 3.0 |
| Anode Current Density | 85 $A/m^2$ | 65 $A/m^2$ |
| Current Passed | 235 Ahr (8.7F) | 50 Ahr (1.87F) |
| Metal Liberated | 3.75g ions | 0.74 g ions |
| Elemental Sulphur formed | 4.2g atoms | 0.66g atoms |
| Sulphate produced | Nil | 0.08g ions |
| Dissolution Efficiency | 95% | 75% |

WORKING EXAMPLE 6

A commercial lead concentrate containing 49.3% Pb, 7.0% Zn and 11.3% Fe was treated in chloride, nitrate and fluosilicate electrolytes. The feed slurry contained 100 g of concentrate per liter of electrolyte. The conditions and results were as follows:

CHLORIDE ELECTROLYTE

Electrolyte: 3 M NaCl, 0.08 M $PbCl_2$
Acidity: pH 3.0
Anode Current Density: 100 $A/m^2$
Anode Area/Anolyte Volume: 55 $m^{-1}$
Current Passed: 60 Ahr (2.25 F)
Metal Liberated: 0.932 g ions
Elemental Sulphur formed: 0.867 g atoms
Sulphate produced: 0.065 g ions
Dissolution Efficiency: 85%

NITRATE ELECTROLYTE

Electrolyte: 1 M $NaNO_3$, 1.25 M $PbNO_3$
Acidity: pH 2.0
Anode Current Density: 50 $A/m^2$
Anode Area/Anolyte Volume: 33 $m^{-1}$
Current Passed: 122 Ahr (4.54 F)
Metal Liberated: 1.52 g ions
Elemental Sulphur formed: 1.489 g atoms
Sulphate produced: 0.195 g ions
Dissolution Efficiency: 75%

FLUOSILICATE ELECTROLYTE

Electrolyte: 0.8 M $PbSiF_6$
Acidity: 0.6 M $H_2SiF_6$
Anode Current Density: 50 $A/m^2$
Anode Area/Anolyte Volume: 33 $m^{-1}$
Current Passed: 118 Ahr (4.4 F)
Metal Liberated: 1.87 g ions
Elemental Sulphur formed: 1.765 g atoms
Sulphate produced: 0.036 g ions
Dissolution Efficiency: 82%

In the working examples, the electrolyte was prepared by dissolving the required amount of metal oxide in the appropriate mineral acid, adding the required weight of soluble salt and making the volume up to a known quantity e.g.:

1. 1290 g of PbO was added to 4 l of 28% $H_2SiF_6$ and made up to 8 l, resulting in electrolyte 0.8 m $PbSiF_6$, 0.6 m $H_2SiF_6$.

2. 650 g of ZnO was added to 1.6 l of conc. HCl, then 585 of NaCl added and made up to 8 l, resulting in an electrolyte 1.25 m NaCl, 1.0 m $ZnCl_2$, pH adjusted to 3.0 with ZnO.

The electrolyte was placed in the cell and heated to operating temperature. The preweighted concentrate was added and electrolysis commenced, using a current determined by the electrode areas and the chosen current densities. The amount of current necessary for complete dissolution of the valuable components from the concentrate was calculated and electrolysis stopped after the appropriate time. The cell temperature and electrolyte level were controlled during electrolysis, after which the electrolyte was filtered and the residue recovered. The deposited metal was removed from the cathodes.

The examples were operated at a preferred temperature of about 95° C.; the process is generally operable at temperatures between about 60° C. and the boiling point of the electrolyte (about 105° C.).

Metal liberation, product formation and electrode efficiencies were determined from mass balances based on samples taken at the beginning and end of each run.

We claim:

1. A process for simultaneous electrodissolution and electrowinning of metals from simple sulphide minerals which comprises establishing a cell having (i) an anode compartment or compartments containing a suspension of particulate sulphide mineral, agitated by mechanical mixing or otherwise so that greater than 80% uniform suspension is achieved, and having a particle size less than 200 μm, the metal content of which is being selectively liberated by an oxidizing environment attributable to the anode;

(ii) a cathode compartment or compartments in which the liberated metal values are electrolytically recovered;

(iii) one or more ion permeable membranes, impermeable to the particulate solids in the suspension, separating the anode and cathode compartments;

(iv) an electrolyte containing anions of soluble salt(s) of the said liberated metal or metals in both anode and cathode compartments, said electrolyte being substantially free from oxidizing lixiviants; and introducing direct current into the cell, and recovering metal values from the cathode.

2. A process according to claim 1 in which the ratio of the anode feeder electrode area to the anolyte volume is greater than 10 $m^{-1}$.

3. A process according to any one of the preceding claims in which the anode current density is between 2 and 200 amperes per square meter.

4. A process according to claim 3 in which the current density is between 60 and 100 amperes per square meter.

5. A process according to claim 3 in which the temperature of the electrolyte is maintained between 60° and 105° C.

6. A process according to claim 3 in which the metal values recovered are chosen from one or more of the group consisting of copper, zinc, lead, nickel, silver, cadmium, molybdenum and tin.

7. A process according to claim 3 in which the anions are chosen from one or more of the group consisting of chloride, sulphate, nitrate and fluosilicate.

8. A process according to claim 7 in which the electrolyte contains fluosilicic acid.

9. A process according to claim 3, in which the electrolyte contains at least one soluble salt chosen from the group consisting of alkali metal and alkaline earth metal salts, in concentration not less than 0.5 M.

10. A process according to claim 9 in which the electrolyte contains at least one soluble salt chosen from the group consisting of sodium, potassium and calcium salts.

11. A process according to claim 1 in which the particle size is less than 60 μm.

12. A process for simultaneous electrodissolution and electrowinning of metals from simple sulphide minerals, using electrically and chemically balanced reactions, said process comprising:

(a) establishing a cell having:

(i) at least one anode compartment containing a suspension of particulate sulphide mineral agitated so that greater than 80% uniform suspension is achieved, said mineral having a particle size less than 200 μm, the metal content of which is selectively liberateable by an oxidizing environment attributable to the anode;

(ii) at least one cathode compartment in which the liberated metal values can be electrolytically recovered;

(iii) at least one ion permeable membrane, impermeable to the particulate solids in the suspension, separating the anode and cathode compartments;

(iv) an electrolyte containing anions of at least one soluble salt of said liberated metal in both anode and cathode compartments, said electrolyte being substantially free from oxidizing lixiviants;

(b) introducing direct electric current into the cell until steady state conditions are achieved, wherein the pH of the electrolyte attains a steady state value in the range of about 0 to 5, and the system thereafter requires no essential additions, other than the mineral to be processed, with the metal content of said mineral being selectively liberated by an oxidizing environment attributable to the anode, and (c) removing metal values from the cathode compartment.

13. Process according to claim 12, wherein the current density is no greater than 100 ampers per square meters.

* * * * *

UNITED STATES PATENT AND TRADEMARK OFFICE

CERTIFICATE OF CORRECTION

PATENT NO. : 4,204,922

DATED : May 27, 1980

INVENTOR(S) : DONALD B. FRASER et al

It is certified that error appears in the above-identified patent and that said Letters Patent are hereby corrected as shown below:

Column 5, line 43, "pitches" should read --pitched--.

Column 6, lines 56 and 57, "74 m" and "38 m" should read --74μm--, and --38μm--, respectively Column 7, line 14, "concentration" should read --concentrate--.

Column 8, line 36, "preweighted" should read --preweighed--.

Column 10, line 42, "ampers" should read --amperes--.

Column 10, line 43, "meters" should read --meter--.

Signed and Sealed this

*Twenty-eighth* Day of *October 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,204,922

DATED : May 27, 1980

INVENTOR(S) : Donald B. Fraser et al

It is certified that error appears in the above—identified patent and that said Letters Patent is hereby corrected as shown below:

Column 2, line 37, after "Sb," insert -- Cb--.

Claim 6, last line, before "cadmium" insert --antimony,--

Signed and Sealed this

*Nineteenth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,204,922

DATED : May 27, 1980

INVENTOR(S) : Fraser et al

It is certified that error appears in the above—identified patent and that said Letters Patent is hereby corrected as shown below:

Column 1, line 38, "alkali earch" should read --alkaline earth metal--.

Column 2, line 37, "Cb", should read --Cd--.

Signed and Sealed this

Second Day of March 1982

[SEAL]

Attest:

GERALD J. MOSSINGHOFF

Attesting Officer

Commissioner of Patents and Trademarks